US005365317A

United States Patent [19]

Folkins et al.

[11] Patent Number: 5,365,317

[45] Date of Patent: Nov. 15, 1994

[54] CHARGING SYSTEM FOR ELIMINATING EDGEBANDING IN AN ELECTROSTATOGRAPHIC PRINTING PROCESS

[75] Inventors: Jeffrey J. Folkins; Daniel M. Bray, both of Rochester; Alex Fioravanti; Kenneth W. Pietrowski, both of Penfield; Gerald T. Lioy; Thomas J. Behe, both of Webster, all of N.Y.

[73] Assignee: Xerox Corporation, Stamford, Conn.

[21] Appl. No.: 161,558

[22] Filed: Dec. 6, 1993

[51] Int. Cl.[5] ..... G03G 15/02

[52] U.S. Cl. ..... 355/225; 355/218

[58] Field of Search ..... 361/225, 235; 250/325; 355/225, 221, 227, 218, 203, 204, 208

[56] References Cited

U.S. PATENT DOCUMENTS 3,883,349 5/1975 Sato ..... 355/218 X
4,603,964 8/1986 Swistak ..... 355/14 CH
4,868,600 9/1989 Hays et al. ..... 355/259
4,912,508 3/1990 Zawadzki et al. ..... 355/208
5,025,155 6/1991 Hattori ..... 355/225 X
5,153,647 10/1992 Barker et al. ..... 355/245
5,153,648 10/1992 Lioy et al. ..... 355/247

FOREIGN PATENT DOCUMENTS 61-88282 5/1986 Japan .

*Primary Examiner*—A. T. Grimley
*Assistant Examiner*—Nestor R. Ramirez
*Attorney, Agent, or Firm*—Denis A. Robitaille

[57] ABSTRACT

A corona generating device of the type in which a control grid adjacent a corona generating electrode regulates the charge deposited onto an imaging surface. The control grid defines elongated apertures located in alignment with the electrode, extending along a portion thereof wherein the control grid is adapted to selectively control the charge deposited on the imaging surface area for preventing development of the edge regions thereof.

17 Claims, 4 Drawing Sheets

CHARGING SYSTEM FOR ELIMINATING EDGEBANDING IN AN ELECTROSTATOGRAPHIC PRINTING PROCESS

This invention relates generally to an electrostatographic printing machine, and more particularly concerns a charging device for eliminating edgebanding in an electrostatographic printing process.

Generally, the process of electrostatographic printing is initiated by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. Charged developing material is subsequently deposited onto the photoreceptive member such that the developing material is attracted to the charged image areas on the photoconductive surface thereof to develop the electrostatic latent image into a visible image. The developing material is then transferred from the photoreceptive member, either directly or after an intermediate transfer step to an intermediate surface, to a copy sheet or other support substrate to create an image which may be permanently affixed to the copy sheet, providing a reproduction of the original document. In a final step, the photoreceptive member is cleaned to remove any residual developing material from the photoconductive surface in preparation for successive imaging cycles.

The described electrostatographic copying process is well known and is commonly used for light lens copying of an original document. Analogous processes also exist in other electrostatographic printing applications such as, for example, ionographic printing and reproduction, where charge is deposited on a charge retentive surface in response to electronically generated or stored images.

Electrostatic latent images can be created on the photoconductive surface in various ways. In a conventional electrostatographic process, electrostatic contrast is created by dividing the charge voltage on the photoconductive surface into two levels. The photoreceptor is charged to a first voltage level, typically on the order of −400–500 volts, and is thereafter imagewise exposed, creating a second charge voltage level in areas corresponding to the input image. Thus, charged image areas corresponding to an electrostatic image are maintained on the photoconductive surface at the full photoreceptor potential ($V_{cad}$ or $V_{ddp}$). These charged image areas are subsequently developed via a so called charged area development (CAD) process. Alternatively, a discharged area development (DAD) process can be utilized, wherein imagewise exposure of the photoconductive surface results in discharging the photoreceptor in the image area to its residual potential, typically −100 volts ($V_{dad}$ or $V_c$). These discharged areas are subsequently developed with toner particles to create a visible image. In the DAD process, the background or non-image areas may also be exposed so as to reduce the photoreceptor potential in non image areas typically referred to as $V_{white}$ or $V_w$.

The process of developing a latent image on a photoreceptive member is carried out at a developer station, whereat toner particles, or marking particles, terms which are used interchangeably throughout this application, are attracted to the latent image for forming a toner powder image on the photoconductive surface so as to develop the latent image. Toner particles are deposited on the electrostatic latent image by various systems. Exemplary development methods and apparatus are described in U.S. Pat. No. 3,618,552, cascade development; U.S. Pat. Nos. 2,874,063; 3,251,706; and 3,357,402, magnetic brush development; U.S. Pat. No. 2,217,776, powder cloud development; and U.S. Pat. No. 3,166,432, touchdown development. With respect to the development methods described by the cited patents, magnetic brush development systems, employing two-component developer mixtures comprised of toner particles and carrier particles are extensively used in electrostatographic devices, since such systems generally provide for the production of high quality images, including dense solid areas, and also reduce unwanted toner deposition in background areas. Nevertheless, problems do exist in the design of simple, inexpensive and efficient two-component systems generally caused, at least in part, by the need to generate a turboelectric charge on the toner particles with a desired polarity of sufficient magnitude.

In view of some of the problems associated with two component systems, there have been considerable efforts directed to designing systems which utilize single-component developer, comprising toner particles only; reference, for example, U.S. Pat. No. 2,846,333. Single component development systems typically use a donor roll for transporting charged toner to the development nip defined by the juxtaposed portions of the donor roll and the photoconductive member. The toner is developed onto the latent image recorded on the photoconductive member by a combination of mechanical and/or electrical forces. Generally, these systems eliminate the need for a developer reservoir as well as toner concentration control systems.

One type of such single component development is known as scavengeless development. In a scavengeless development system, a donor roll is provided with a plurality of electrode wires closely spaced therefrom in a development nip. An AC voltage is applied to the electrode wires, forming a toner cloud in the development region. Thereafter, the electrostatic fields generated by the latent image attract toner from the toner cloud to develop the latent image. In a scavengeless development system, an electrode wire is stretched across the donor roll and anchored below the roll surface such that the wire forms an angle relative to the edge of the donor roll. This angle is termed the wire edge angle. This angle is required to insure uniform wire contact with the donor roll because the position of the anchor point varies slightly due to manufacturing tolerances. That is to say that holding the wire more than a small distance above the roll surface results in image deletions near the roll ends. On the other hand, holding the wire too low beneath the surface creates a stress condition resulting in an image defect, referred to as edgebanding, where the developed image density at the roll ends becomes excessive and not equal to the density at the center of the roll. Hence, the force at the interface of the wire and the roll end, created by the edge angle and wire tension, is a critical parameter for edgebanding.

Edgebanding creates an undesirable image defect on an output copy sheet. Further, if left unattended, the developed edgeband will cause rapid reduction of the machine toner supply. At the same time, a heavy cleaning load is imposed on the cleaning system by the deposit of superfluous toner on the photoreceptive member. Edgebanding is clearly an undesirable effect. Various types of development systems have hereinbefore been used as illustrated by the following art which may be relevant to certain aspects of the present invention.

U.S. Pat. No. 4,868,600 Patentee: Hays et al. Issued: Sep. 19, 1989

U.S. Pat. No. 5,153,647 Patentee: Barker et al. Issued: Oct. 6, 1992

U.S. Pat. No. 5,153,648 Patentee: Lioy et al. Issued: Oct. 6, 1992

U.S. Pat. No. 4,603,964 Patentee: Swistak Issued: Aug. 5, 1986

The relevant portions of the foregoing disclosures may be briefly summarized as follows:

U.S. Pat. No. 4,868,600 describes a scavengeless development system in which a donor roll has toner deposited thereon. A pair of electrode wires are closely spaced to the donor roll in the gap between the donor roll and the photoconductive member. An AC voltage is applied to the electrode wires to detach toner from the donor roll and form a toner powder cloud in the gap. Toner from the toner powder cloud is attracted to the latent image recorded on the photoconductive member to develop the latent image recorded thereon. A conventional magnetic brush used with two component developer could be used for depositing the toner layer onto the donor roll.

U.S. Pat. No. 5,153,647 describes an apparatus for developing latent images on a photoconductive member having a donor member for transporting toner particles to a development zone adjacent the photoconductive member. Electrically biased electrode wires are positioned in the development zone so as to detach toner particles from the donor roll, forming a toner cloud to develop the latent image. The electrode wires are adjustably supported in tension adjacent the donor member.

U.S. Pat. No. 5,153,648 describes an apparatus in which a donor roll advances toner to an electrostatic latent image recorded on a photoconductive member, wherein a plurality of electrode wires are positioned in the space between the donor roll and the photoconductive member. A support contacts the electrode wires at at least two points. One of the contact points is selected to minimize the wire edge angle between with the other of the contact points being selected to minimize the wire free span. In this way, edgebanding and strobing effects are minimized.

U.S. Pat. No. 4,603,964 discloses a charge scorotron having a U-shaped shield positioned opposite a photoreceptor, a corona discharge wire, and a grid positioned between the wire and the photoreceptor, the grid being electrically subdivided. Switches are provided for connecting each of the subdivided grid elements to a biasing source whereby the area of the photoreceptor which is charged is determined by the number of grid segments coupled to the grid biasing source.

In accordance with one aspect of the present invention, there is provided a corona generating device, comprising a support frame including an elongated body and opposing end portions, a corona generating electrode mounted in the support frame, and a control grid mounted on the support frame in spaced relation to the corona generating electrode such that the control grid defines an elongated aperture located in substantial alignment with the electrode, extending along a portion thereof.

Pursuant to another aspect of the invention there is provided an electrostatographic printing apparatus including a corona generating device for depositing a charge on an imaging surface. The corona generating device comprises a support frame including an elongated body and opposing end portions, a corona generating electrode mounted in the support frame, and a control grid mounted on the support frame in spaced relation to the corona generating electrode such that the control grid defines an elongated aperture located in substantial alignment with the electrode, extending along a portion thereof.

In accordance with another aspect of the present invention, an electrostatographic printing apparatus, including an imaging member having a surface area and opposing edge regions is provided. The printing apparatus comprises: means for depositing a charge on the imaging member; means for imagewise exposing the charged imaging member to generate a latent electrostatic image on the surface area thereof; a scavengeless development system for producing a toner cloud to develop the latent electrostatic image on the imaging member, wherein the toner cloud tends to develop the opposing edge regions of the imaging member. The charge depositing means further includes: a corona generating electrode and a control grid mounted in spaced relation between the corona generating electrode and the imaging member, wherein the charge depositing means adapted to selectively control the charge deposited on the surface area and the opposing edge regions of the imaging member for preventing development of the opposing edge regions thereof.

In accordance with yet another aspect of the present invention, a method for varying charge potential deposited on selective portions of an imaging surface in an electrostatographic printing apparatus is disclosed. The method comprises the steps of providing a corona generating device including a corona generating electrode and a control grid mounted in spaced relation between the corona generating electrode and the imaging surface, said control grid defining an elongated aperture located in substantial alignment with the electrode, extending along a portion thereof, applying an electrical bias to the corona generating device such that the charge potential deposited on the imaging surface in the area adjacent the control grid is of a first magnitude and the charge potential deposited on the imaging surface in the area adjacent the aperture is of a second magnitude.

The features of the present invention will become apparent as the following description proceeds and upon reference to the drawings, in which.

Figure 1:
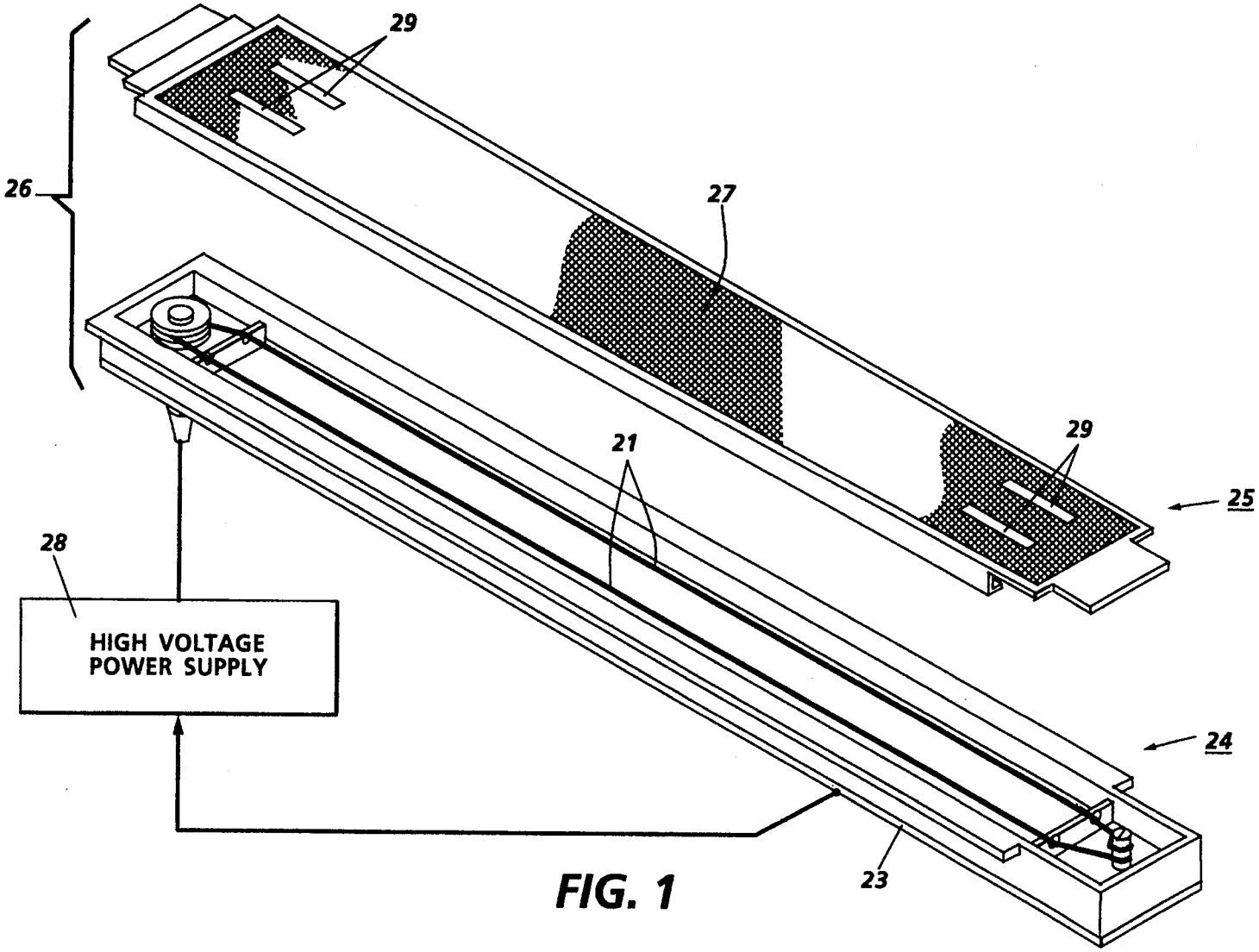
FIG. 1 is a perspective view of a charging device in accordance with the present invention.

While the present invention will be described in connection with a preferred embodiment thereof, it will be understood that the detailed description is not intended to limit the invention to that embodiment. On the contrary, it is intended that the invention cover all alternatives, modifications, and equivalents as may be included within the spirit and scope thereof as defined by the appended claims. Other aspects and features of the present invention will become apparent as the description proceeds wherein like reference numerals have been used throughout to designate identical elements.

Figure 4:
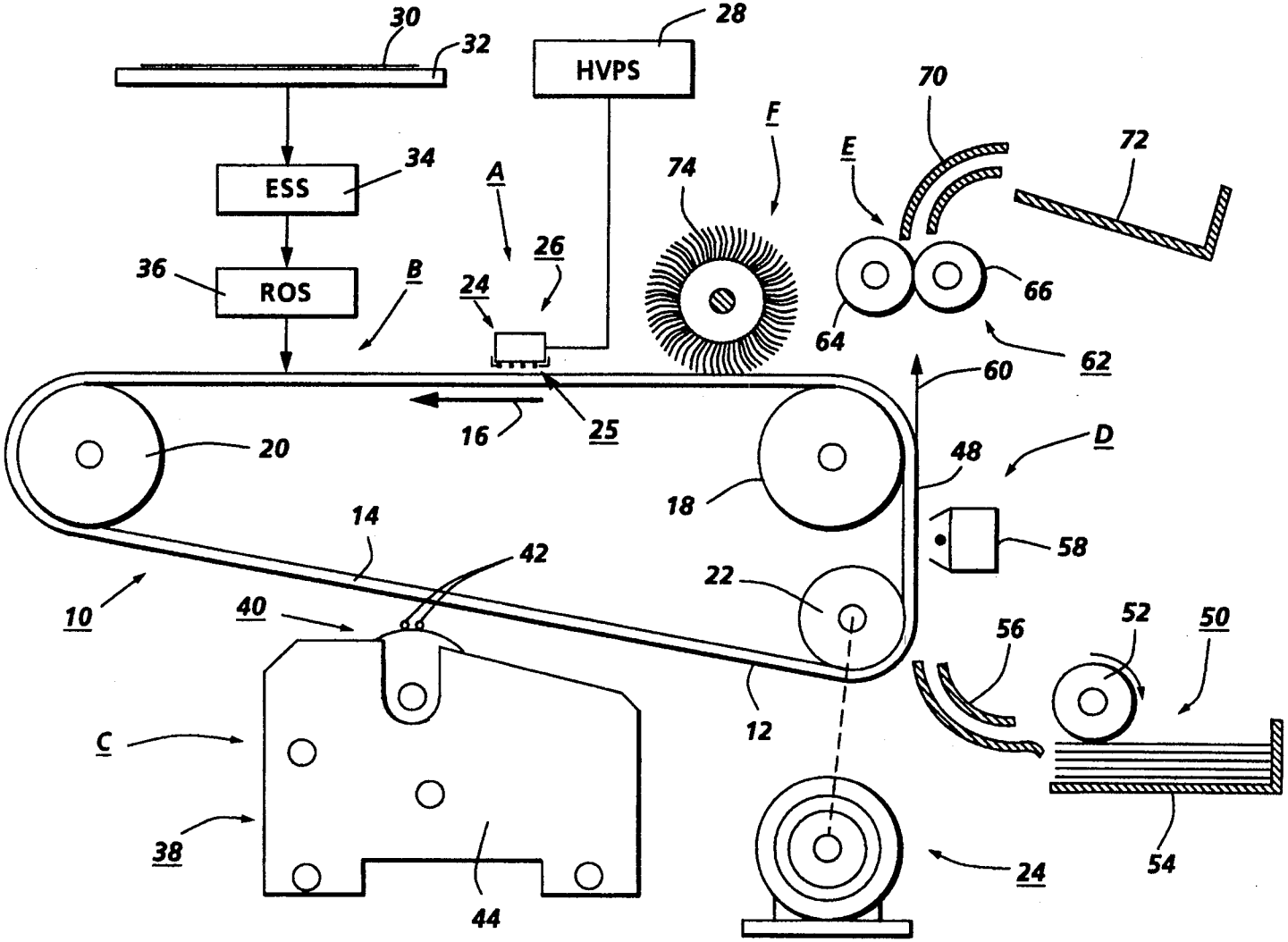
FIG. 4 is a schematic elevational view of an illustrative electrostatographic printing machine incorporating a scavengeless development system and the charging device of the present invention.

For a general understanding of an electrostatographic printing machine in which the features of the present invention may be incorporated, reference is initially made to FIG. 4, before describing the specific details of the present invention. Inasmuch as the art of electrostatographic printing is well known, the various processing stations employed in the printing machine depicted in FIG. 4 will be shown hereinafter schematically and their operation will be described briefly with reference thereto. It will become apparent from the following discussion that the charging device of the present invention is equally well suited for use in a wide variety of electroreprographic machines, as well as a variety printing, duplicating and facsimile devices.

FIG. 4 shows an illustrative, electrophotographic printing machine which employs a belt 10 having a photoconductive surface 12 deposited on a conductive substrate 14. One skilled in the art will appreciate that photoconductive belt 10 may be made from any suitable photoconductive material, such as a selenium alloy, for example. Conductive substrate 14 is preferably made from an aluminum alloy and is electrically grounded. Belt 10 is entrained about stripping roller 18, tensioning roller 20 and drive roller 22, each roller being rotatably mounted in engagement with belt 10 to advance belt 10 in the direction of arrow 16 for transporting successive portions of photoconductive surface 12 sequentially through the various processing stations disposed about the path of movement thereof. Roller 22 is coupled to motor 24 by suitable means, such as a belt drive for advancing belt 10 about the curvilinear path shown in FIG. 4.

Initially, a portion of belt 10 passes through charging station A. At charging station A, a corona generating device, indicated generally by the reference numeral 26 charges photoconductive surface 12 to a relatively high, substantially uniform potential. Charging is conveniently accomplished by exposing the surface of the charge retentive surface to a corona source, the polarity of which is chosen to produce the desired results upon the particular surface being charged. The corona source is commonly provided by one or more fine wires or other electrode device positioned close to the surface. When a high voltage potential is applied to the electrode(s), a corona is generated or discharged and ions are attracted to and deposited on the photoconductive surface 12. Superior image reproductions are obtainable only when very uniform electrostatic charges are established on the surface to be imaged.

High voltage corona generating devices generate and deliver a corona current which is typically employed to produce substantial charge potentials at the photoconductive surface 12. These currents, however, are often non uniform along the length of the corona emitting electrode, resulting in a non-uniform charge potential at the photoconductive surface 12. Similarly, voltage non-uniformities can be caused by variations in photoreceptor charge acceptance properties both in the direction of the process and perpendicular to it in the direction of the corona emitting electrode. These variations are usually caused by localized variations in photoreceptor charge leakage, a phenomena commonly referred to as differential dark decay. One technique employed to achieve charge uniformity on a surface in the presence of non-uniform electrode current emission or differential dark decay is the use of a wire grid or screen 25 placed between the corona emitting electrode and the surface. This apparatus is commonly referred to as a scorotron, first described in U.S. Pat. No. 2,777,957. The grid 25 is maintained at a predetermined potential and serves to terminate further charging of the surface when the surface potential on all portions of the surface corresponds to the grid potential. The grid can be grounded or biased by means of an external voltage source, or it can be self-biased by connecting the grid to ground arrangement through current flow restricting devices (an example of the latter being illustrated in U.S. Pat. No. 3,729,649). The charging device of the present invention will be described in further detail hereinbelow with reference to FIG. 1.

After photoconductive surface 12 of belt 10 is charged, the charged portion thereof is advanced through exposure station B. At exposure station B, an original document 30 is placed face down upon a transparent platen whereat a raster input scanner (RIS), indicated generally by reference numeral 32, containing document illumination lamps, optics, a mechanical scanning device, and a charge coupled device such as CCD array, captures the image from original document 30. The RIS 32 converts the image to a series of raster scan lines and this information is transmitted as an electrical signal to an electronic subsystem (ESS), indicated generally by the reference numeral 34, which contains control electronics for preparing and managing the image data flow to a raster output scanner (ROS), indicated generally by the reference numeral 36. The ROS 36 selectively discharges the charged portion of the photoconductive member in a series of horizontal scan lines with each line having a certain number of pixels per inch. This records an electrostatic latent image on photoconductive surface 12 which corresponds to the informational image areas contained within original document 30. One of skill in the art will appreciate that a commonly known light lens exposure system may be incorporated in lieu of the digital system described hereinabove.

One skilled in the art will appreciate that in lieu of the light lens system described hereinabove, a raster output scanner (ROS) may be employed.

After the electrostatic latent image has been recorded on photoconductive surface 12, belt 10 advances the latent image to development station C. At development station C, a development system indicated generally by the reference numeral 38, develops the latent image recorded on the photoconductive surface 12. Preferably, in the context of the present invention, development system 38 is a scavengeless type development system including a donor roll 40 and electrode wires 42. Electrode wires 42 are electrically biased relative to donor roll 40 to detach toner therefrom so as to form a toner powder cloud in the gap between the donor roll 40 and the photoconductive surface 12. The latent image recorded on the photoconductive surface 12 attracts toner particles from the toner powder cloud forming a toner powder image thereon. Donor roll 40 is mounted, at least partially, in the chamber of developer housing 44. The chamber in developer housing 44 has a supply of developer material therein. The development apparatus will be discussed hereinafter, in greater detail, with reference to FIG. 3.

With continued reference to FIG. 4, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with the photoconductive surface 12 of belt 10 in a timed sequence so that the toner powder image developed thereon contacts the advancing sheet at transfer station D. Transfer station D includes a corona generating device 58 which sprays ions onto the back side of sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transfer powder image to sheet 48. Fuser assembly 62 includes a heated fuser roller 64 and a backup roller 66. Sheet 48 passes between fuser roller 64 and backup roller 66 with the toner image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 3:
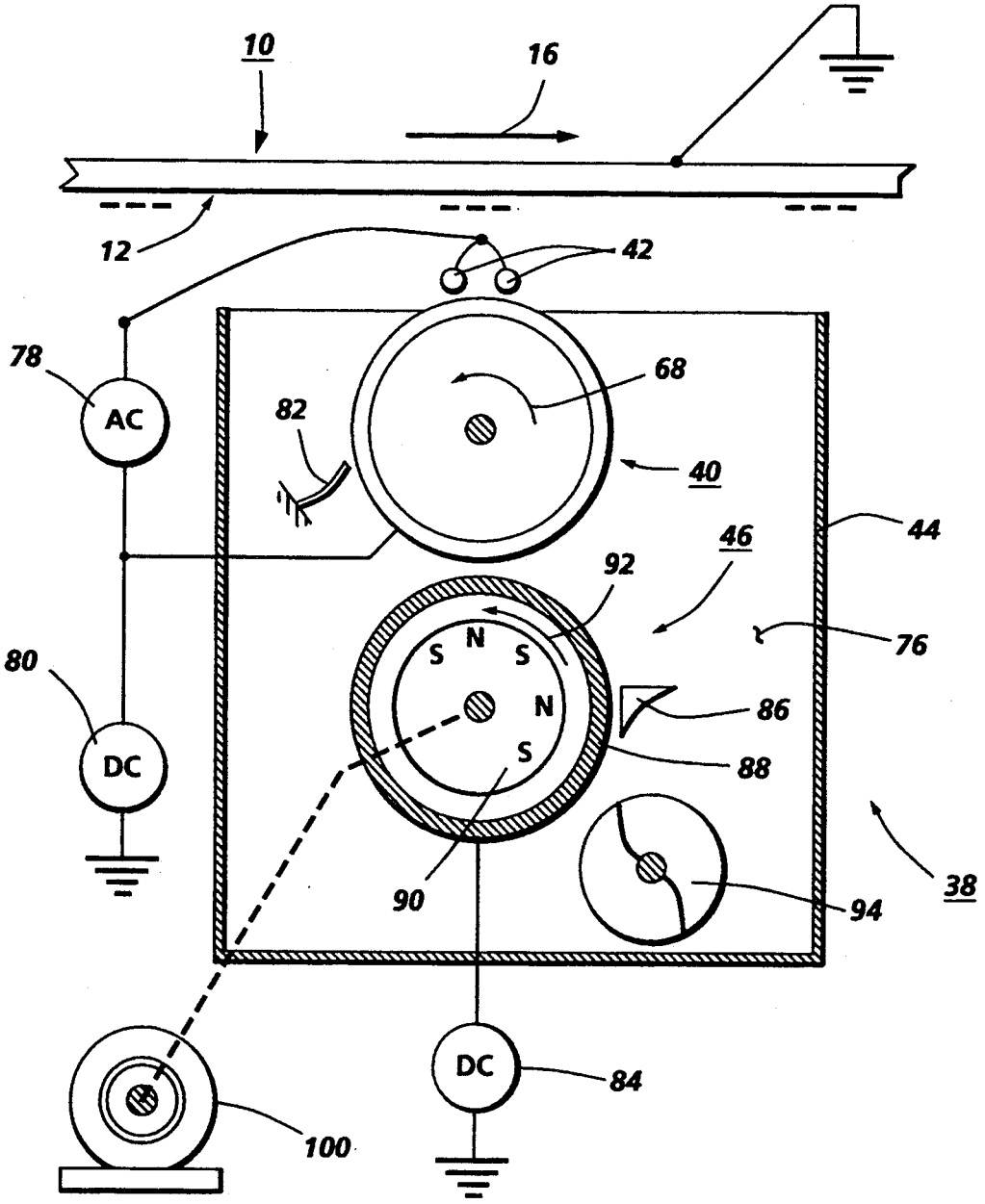
FIG. 3 is a schematic elevational view showing a scavengeless development apparatus.

Referring now to FIG. 3, a scavengeless development system 38, as is well known in the art, is shown in greater detail. The system includes a housing 44 defining a chamber 76 for storing a supply of developer material therein. Donor roll 40, electrode wires 42 and magnetic roller 46 are mounted in chamber 76 of housing 44. A pair of electrode wires 42 are shown extending in a direction substantially parallel to the longitudinal axis of the donor roll 40. The electrode wires 42 are made from of one or more thin (i.e. 50 to 100 μm diameter) stainless steel wires which are closely spaced adjacent to donor roll 40. The distance between the wires and the donor roll 40 is approximately 25 μm which is substantially equivalent to the thickness of the toner layer deposited on the donor roll 40. The wires 42 are self-spaced from the donor roll 40 by an appropriate distance so that the thickness of the toner layer on the donor roll 40 can pass thereunder. To this end, the extremities of the wires 42 can be supported by bearing blocks (not shown) which support the donor roll 40 for rotation. Mounting the wires 42 in such a manner makes them insensitive to roll runout due to their self-spacing.

With continued reference to FIG. 3, an alternating electrical bias is applied to the electrode wires by an AC voltage source 78. The applied AC voltage establishes an alternating electrostatic field between the wires and the donor roll 40 which is effective in detaching charged toner from the surface of the donor roll 40 for forming a toner powder cloud about the wires 42. The toner in the cloud is substantially in contact with belt 10. The magnitude of the AC voltage is relatively low, on the order of 200 to 600 volts peak at a frequency ranging from about 3 kilohertz to about 10 kilohertz. A DC bias supply 80, which applies approximately 300 volts to donor roll 40, establishes an electrostatic field between photoconductive surface 12 of belt 10 and donor roll 40 for attracting the detached toner particles from the cloud surrounding the wires to the latent image recorded on the photoconductive surface 12. At a spacing ranging from about 10 microns to about 40 microns between the electrode wires and the donor roll 40, an applied voltage of 200 to 600 volts produces a relatively large electrostatic field without risk of air breakdown. The use of a dielectric coating and electrode wires with the donor roller helps to prevent shorting of the applied AC voltage. A cleaning blade 82 may also be provided for stripping all of the toner from donor roller 40 after development. A magnetic roller 46 meters fresh toner to the clean donor roll 40. A DC bias supply 84, applying approximately 100 volts to magnetic roller 46, establishes an electrostatic field between magnetic roller 46 and donor roll 40 so that the electrostatic field established causes toner particles to be attracted from the magnetic roller 46 to the donor roll 40. Metering blade 86 is positioned closely adjacent to magnetic roller 46 to maintain the compressed pile height of the developer material on magnetic roller 46 at the desired level. Magnetic roller 46 includes a nonmagnetic tubular member or sleeve 88 made preferably from aluminum and having the exterior circumferential surface thereof roughened. An elongated multi-pole magnet 90 is positioned within of and spaced from, the tubular member. Elongated magnet 90 is mounted stationarily. Tubular member 88 is mounted on suitable ball bearings and rotates in the direction of arrow 92. Motor 100 rotates tubular member 88. Developer material is attracted to tubular member 88 and advances thereabout into the nip defined by donor roll 40 and magnetic roller 46 where toner particles are attracted to the donor roller.

In a scavengeless system as shown, fringe electric fields supplied by biased electrodes 42 in close proximity with a toned donor roll 40 enable non-interactive development on the photoconductive surface 12 since the toner in the cloud formed near the electrodes 42 is not projected against the image with high kinetic energy. The electric field is able to detach the toner from the donor roll 40 to form a cloud adjacent the electrode wires 42. Since the toner cloud is spaced from the photoconductive surface 12, toner does not impinge on previously deposited toner images thereon. However, if the toner cloud is spaced too far away, the development of lines will be narrowed since the fringe fields at the edges of the lines do not reach into the toner cloud. Thus, in order to obtain line development fidelity, it is important to bring the toner cloud as close as possible to the image receiver. To accomplish this, one could either reduce the gap or increase the cloud height. However, the gap reduction approach has limitations since present manufacturing and machine setup tolerances require gaps >200 μm. With respect to increasing the cloud height, it is noted that if the height of the toner cloud is proportional to the amplitude of toner particle motion due to an applied electric field, one expects the height to be related to the toner charge-to-mass ratio and the peak electric field. Since the ranges of the toner charge and peak electric field are limited, an increase in the bias voltage applied to electrodes 42 provides an effective way of increasing the cloud height.

Figure 2:
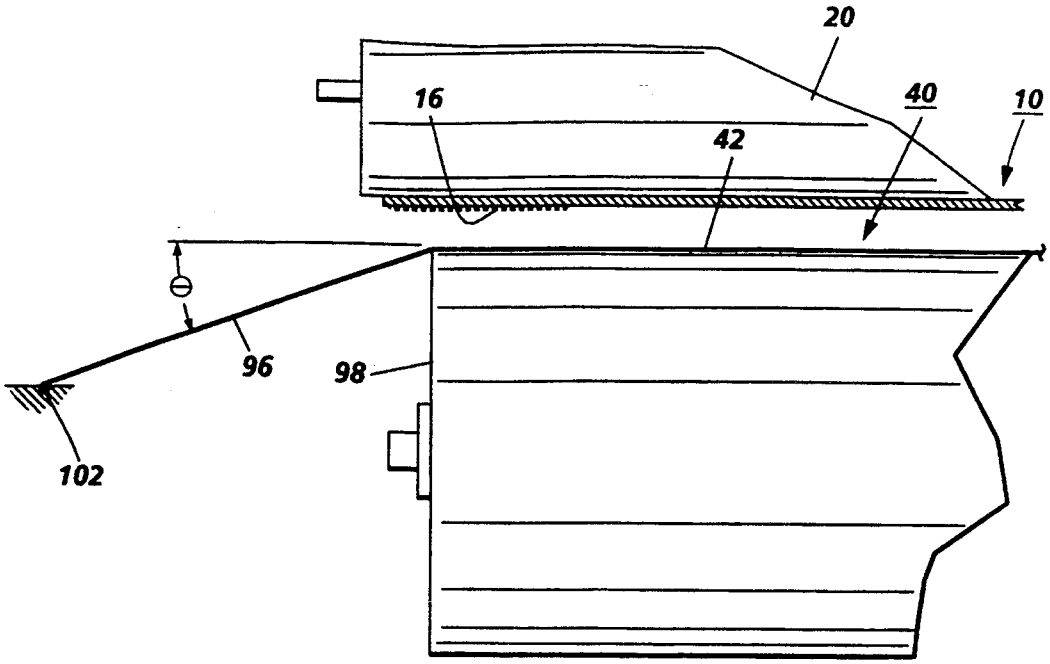
FIG. 2 is a plan view depicting a scavengeless development system and the edgebanding effect created by the electrode wires used in the development system.

Referring now to FIG. 2, a partial view of, the scavengeless development system of FIG. 3 is shown in plan view with photoreceptor 10 adjacent donor roll 40 and electrodes 42. The degree of freedom of the electrode wires 42 relative to the donor roll 40 is constrained at a point close to the ends of the donor roll 40. In FIG. 2, the electrode wire 42 extends from edge 98 of donor roll 40 to an anchor point 102 where the electrode wire 42 is secured fixedly to the machine frame. The radial position of the wire end is held at a point sufficiently far from the end of the donor roll 40 so that a small wire edge angle is formed. The wire edge angle is defined as the angle between the longitudinal axis of the donor roller 40 and the wire span 96, as shown. It can be seen from FIG. 2 that a small area of toner, identified by reference numeral 16, is developed on the surface of the photoconductor 10 adjacent the edge thereof, in a region corresponding to the donor edge 98. Toner development in this region is a commonly known phenomenon called "edgebanding", a caused by excess pressure and position of the wire 42 which, in turn, causes a variability and offset in the developability performance of the system near the ends of the donor roller 40. The tension on the wire at the region proximate to the roll end 98 and the magnitude of the wire edge angle created thereat are the critical parameters which contribute to edgebanding. It has been shown that minimizing the wire edge angle will minimize edgebanding. However, the minimum edge angle that can be maintained in manufacturing decreases as wire span 96 decreases such that edgebanding is difficult to completely eliminate by known methods.

The present invention is directed toward eliminating or reducing edgebanding by varying the charge potential on the photoreceptive member in areas in which edgebanding occurs. Referring particularly to FIG. 1 of the drawings, a modified form of a typical scotorton charging device is depicted. A typical scorotron charging device 26 generally includes an elongated body composed of frame members 24, 25 which are assembled together, as shown. The charging device 26 also includes electrode wires 21 which are stretched tightly in the direction of the longitudinal axis of the elongated body within a channel formed by U-shaped frame member 24. The overall length of the corona wires 21 is at least equal to the operating width of the photoreceptive member 10. While a two corona wire design is shown, a single corona wire or other corona wire multiples, as well as a pin array type corona generating electrode, as is well known in the art, may be utilized in the practice of the present invention. The corona generating electrodes 21 are coupled to a suitable high voltage power supply 28 which may comprise either a DC, an AC, or a combined AC/DC type electrical source. In addition, the power supply 28 may be coupled to an outer conductive wail 23 of the charging device as shown, providing electrical feedback for controlling the potential applied to the corona wires 21 in accordance with the corona discharge level such that a desired charge level may be maintained. Alternatively, the total corona current can be regulated by utilizing a constant current power supply such that the coronode voltage will increase or decrease as necessary to maintain a constant total corona current.

Frame member 25 includes an apertured grid 27 which comprises an expanded open mesh metal screen being placed over the open end of frame member 24 with the grid 27 in predetermined space relation relative to the corona generating electrodes 21. It will be understood that frame members 24 and 25 may have a plurality of co-dependent interlockable elements for locking frame member 21 in preset operating position with respect to frame member 24. Grid 27 is provided with an operating potential, typically derived from a plurality of zener diodes (not shown), resulting in a self-biasing control of the grid 27 for maintaining the voltage across the screen at a predetermined potential. In some applications it may be desirable to change the grid bias by using an independently controlled power supply. The scorotron grid 27 helps control the charge strength and the charge uniformity on the photoreceptor by forming an additional electrostatic field between the grid 27 and the corona generating electrode 21, as is well known in the art. The charging device described hereinabove is generally known as a scorotron and is suitably mounted in the printing machine with grid 25 facing toward and in predetermined space relation to the photoreceptive member 10.

In an effort to address the problem of edgebanding described hereinabove, the present invention provides a unique scorotron charging device wherein the control grid 27 thereof is adapted to modify the grid voltage in areas corresponding to the edgebanding region for suppressing development thereat.

In a preferred embodiment or the present invention, as shown in FIG. 1, slots or elongated apertures 29 are positioned in the scorotron grid 27 near the ends of the corona charging device, directly adjacent to and in alignment with the corona generating electrodes 21 in an area corresponding to the edgebanding region. The elongated apertures 29 allow additional charge to be deposited on the photoconductive surface 12 relative to the charge deposited on the other areas of the photoreceptive member 10 where the normal grid 27 exists. The present invention reduces edgebanding development by causing the charge potential in the affected areas on the photoreceptive member 10 to be raised above the nominal charge level thereof. In the case of discharge area development (DAD), improved edgebanding performance can be achieved by modifying the grid 27 to provide a higher charge on the photoconductive surface 12 of the photoreceptive member 10 in the areas prone to edgebanding.

It has been shown through experimentation that the elongated apertures 29 provided in the grid 27, in accordance with the present invention, allow the photoreceptor charge voltage to be increased by up to 400 volts with respect to the nominal charge voltage applied to the main body of the photoconductive surface 12. This charge voltage differential can be varied, as desired, by varying the dimension of the elongated aperture 29. As will be understood, the additional charge voltage acts as a cleaning field which suppresses development in a discharge area development (DAD) type system.

It will be understood by those of skill in the art that the charge device of the present invention may be modified in many different ways to achieve the desired edgebanding elimination. For example, instead of providing rectangular elongated apertures 29, as shown in FIG. 1, the apertures of the control grid 27 may simply be enlarged or rearranged in the areas corresponding to the edgebanding affected areas on the photoreceptive member, in any manner which allows an increase in the charging potential delivered to the photoreceptive surface 12. Alternatively, the end portions of the grid 27 could be separately biased at a higher potential than the main portion of the grid for arriving at the advantageous increased charge voltages. A segregated scorotron grid which could be adapted to suit this latter alternative embodiment is disclosed in U.S. Pat. No. 4,603,964; that patent is incorporated by reference herein. Other alternative embodiments might include increasing the charge potential generated by the corona generating electrode in the desired edgebanding regions, as, for example, by increasing the number of pins in desired regions of a pin array electrode. Additional changes to the internal charging geometry of a corona generating device for increasing charging levels in desired regions will be apparent to those of skill in the art.

In recapitulation, it is evident from the preceding description that a charging device having a control grid including voltage increasing apertures therein has been disclosed. This unique control grid is adapted for modifying the charge voltage applied to a photoconductive surface in areas corresponding to edgebanding regions to suppress development thereat. The present invention is particularly useful in combination with an electrostatographic system utilizing discharge area development processes and a scavengeless electrical development system in which edgebanding occurs. It will be understood that various other types of development systems exist which may suffer from similar problems as discussed therein, wherein the present invention may be adapted to provide a solution. It will also be understood that the present invention may be used in multiple charging steps of various electrostatographic applications such as multicolor image-on-image systems which are known in the art.

It is, therefore, apparent that there has been provided in accordance with the present invention, a charging system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A corona generating device for depositing charge on an adjacent surface, comprising:

a support frame;

a corona generating electrode mounted in said support frame; and control grid means mounted on said support frame in spaced relation to said corona generating electrode, said control grid means defining an elongated aperture located in substantial alignment with said electrode, extending along a portion thereof, for varying the charge deposited on the adjacent surface.

2. The corona generating apparatus of claim 1, wherein said support frame includes an elongated body and opposing end portions.

3. The corona generating device of claim 2, wherein the elongated aperture is located adjacent to at least one of said opposing end portions.

4. The corona generating device of claim 2, wherein said corona generating electrode includes a thin wire extending along said elongated body between said opposing end portions.

5. The corona generating device of claim 2, wherein said corona generating electrode includes a linear pin array extending along said elongated body between said opposing end portions.

6. The corona generating device of claim 1, wherein said control grid means includes an open mesh conductive screen.

7. The corona generating device of claim 1, wherein said corona generating electrode includes a plurality of thin wires.

8. An electrostatographic printing apparatus including a corona generating device for depositing a charge on an imaging surface, comprising:

a support frame;

a corona generating electrode mounted in said support frame; and control grid means mounted on said support frame in spaced relation between said corona generating electrode and said imaging surface, said control grid means defining an elongated aperture located in substantial alignment with said electrode, extending along a portion thereof, for varying the charge deposited on said imaging surface.

9. The electrostatographic printing apparatus of claim 8, wherein said support frame includes an elongated body and opposing end portions.

10. The electrostatographic printing apparatus of claim 9, wherein the aperture is located adjacent to at least one of said opposing end portions.

11. The electrostatographic printing apparatus of claim 9, wherein said corona generating electrode includes a thin wire extending along said elongated body between said opposing end portions.

12. The electrostatographic printing apparatus of claim 9, wherein said corona generating electrode includes a linear pin array extending along said elongated body between said opposing end portions.

13. The electrostatographic printing apparatus of claim 8, wherein said control grid means includes an open mesh conductive screen.

14. The electrostatographic printing apparatus of claim 8, wherein said corona generating electrode includes a plurality of thin wires.

15. An electrostatographic printing apparatus, including an imaging member including a surface area and opposing edge regions, comprising:

means for depositing a charge on the imaging member;

means for imagewise exposing the charged imaging member to generate a latent electrostatic image on the surface area thereof;

a development system for producing a toner cloud to develop the latent electrostatic image on said imaging member, wherein the toner cloud tends to develop the opposing edge regions of said imaging member;

wherein said charge depositing means includes:

a corona generating electrode; and a control grid mounted in spaced relation between said corona generating electrode and said imaging member, wherein said charge depositing means is being adapted to vary the charge deposited on the surface area and the opposing edge regions of the imaging member for preventing development of the opposing edge regions thereof.

16. A method for varying charge potential deposited on selective portions of an imaging surface in an electrostatographic printing apparatus, comprising the steps of:

providing a corona generating device including a corona generating electrode and a control grid mounted in spaced relation between said corona generating electrode and said imaging surface, said control grid defining an elongated aperture located in substantial alignment with said electrode, extending along a portion thereof; and applying an electrical bias to said corona generating electrode, wherein the charge potential deposited on said imaging surface is varied by a presence or absence of said elongated aperture such that the charge potential in the area adjacent the absence of said elongated aperture is of a first magnitude and the charge potential deposited on said imaging surface in the area adjacent the presence of said elongated aperture is of a second magnitude.

17. The method of claim 16, wherein said electrical bias applying step is adapted to eliminate edgebanding.

* * * * *